US005124229A

United States Patent [19]

De Keyzer et al.

[11] Patent Number: 5,124,229

[45] Date of Patent: * Jun. 23, 1992

[54] PROCESSING LIQUID WITH COMBINATION OF TONERS FOR SILVER COMPLEX DIFFUSION TRANSFER PROCESSING

[75] Inventors: René M. De Keyzer, Sint-Niklaas; Raymond L. Odeurs, Edegem; Luc A. De brabandere, Lier, all of Belgium

[73] Assignee: AGFA-Gevaert, N.V., Mortsel, Belgium

[ * ] Notice: The portion of the term of this patent subsequent to Nov. 5, 2008 has been disclaimed.

[21] Appl. No.: 524,464

[22] Filed: May 17, 1990

[30] Foreign Application Priority Data

May 18, 1989 [EP] European Pat. Off. ..... 89201254.3

[51] Int. Cl.[5] ..... G03C 5/54; G03C 5/46

[52] U.S. Cl. ..... 430/248; 430/233; 430/249; 430/251; 430/455; 430/449; 430/486; 430/487; 430/490; 430/492; 430/965

[58] Field of Search ..... 430/233, 248, 249, 251, 430/455, 456, 486, 487, 490, 444, 965, 492

[56] References Cited

U.S. PATENT DOCUMENTS 4,568,634 2/1986 Hayashi ..... 430/249

4,632,896 12/1986 Tsubai et al. ..... 430/249

*Primary Examiner*—Richard L. Schilling

*Attorney, Agent, or Firm*—Breiner & Breiner

[57] ABSTRACT

An aqueous alkaline processing liquid suitable for use in the silver complex diffusion transfer reversal (DTR-) process, wherein said liquid contains one or more alkanolamines, the said alkanolamine(s) consisting of one or more tertiary alkanolamines in an amount in the range from 0.3 mol to 1.5 mol/l, and one or more secondary alkanolamines in an amount from 0 mol % to 5 mol % with respect to the amount of tertiary alkanolamine(s), and said liquid also contains a mixture of a silver image toning agent A being 1-phenyl-1H-tetrazole-5-thiol or a tautomer thereof and at least one other silver image toning agent B being a 1-phenyl-1H-tetrazole-5-thiol or a tautomer thereof, wherein the phenyl nucleus is substituted with halogen, the toning agent A and toning agent(s) B being present in said liquid in a molar ratio from 1/15 to 15/1.

17 Claims, No Drawings

PROCESSING LIQUID WITH COMBINATION OF TONERS FOR SILVER COMPLEX DIFFUSION TRANSFER PROCESSING885

BACKGROUND OF THE INVENTION

The present invention relates to a processing liquid suitable for use in the silver complex diffusion transfer reversal process.

The principles of the silver complex diffusion transfer reversal process, hereinafter called DTR-process, have been described e.g. in U.S. Pat. No. 2,352,014 and in the book "Photographic Silver Halide Diffusion Processes" by André Rott and Edith Weyde—The Focal Press—London and New York, (1972).

In the DTR-process non-developed silver halide of an information-wise exposed photographic silver halide emulsion layer material is transformed with a so-called silver solvent into soluble silver complex compounds which are allowed to diffuse into an image-receiving element and are reduced therein with a developing agent, generally in the presence of physical development nuclei, to form a silver image having reversed image density values with respect to the silver image obtained in the exposed photographic material.

The developing agent or a mixture of developing agents can be present in an alkaline processing solution and/or in the photographic silver halide emulsion layer material. In case the developing agent or a mixture of developing agents is contained in the photographic silver halide emulsion material, the processing solution can be merely an aqueous alkaline solution that initiates and activates the development.

Suitable developing agents for the exposed silver halide are e.g. hydroquinone-type and 1-phenyl-3-pyrazolidone-type developing agents as well as p-monomethylaminophenol.

The silver halide solvent, mostly sodium thiosulphate, may be supplied from the non-light-sensitive image-receiving element as mentioned above, but it is normally at least partly already present in the alkaline processing solution.

The alkaline processing solution usually contains sufficient alkaline substances to bring the pH above 10, e.g. sodium hydroxide, sodium carbonate and a great many other compounds which can raise the pH, for example borax, tertiary sodium phosphate, lithium hydroxide and amines, particularly alkanolamines.

The use of amines and alkanolamines in processing solutions for the silver complex diffusion transfer reversal process is described e.g. in U.S. Pat. Nos. 2,702,244, 4,568,634 and 4,632,896 and GB 2 159 968.

Tertiary alkanolamines having a pKa value higher than 8.5 and their use in the DTR-process are described in Research Disclosure, Jul. 1987, item 27939.

The DTR-process initially intended for office copying purposes has found now wide application in the graphic art field, more particularly in the production of screened prints from continuous tone originals.

For the latter purpose it is particularly important that the processing characteristics remain steady for a large set of prints and that the gradation, optical density (transmission density in the case of film material and reflection density in the case of opaque material e.g. paper material) and the neutrality of the colour tone (black) of the screen dots in the screened prints satisfy graphic art standards which are particularly high compared with normal copying.

It has been established experimentally that DTR-processing solutions containing alkanolamines and more particularly tertiary alkanolamines as alkalinity source offer the advantage of having a comparatively low carbon dioxide absorption and consequently provide a better pH stability and more equal reaction kinetics to the processing solution over a prolonged period of time.

Unfortunately when using alkanolamines DTR-images are obtained that are more or less stained and of which the silver images are not purely black (ref. the above mentioned book of A. Rott and E. Weyde, p. 66).

As is described in the same book on said page 66 it is common practice to avoid the formation of silver images having a brown or yellow image by using silver image-toning agents such as heterocyclic mercapto compounds which influence the amount, the nature and the grain size of the silver deposits of the reduced silver. As a very effective black-toning agent 1-phenyl-1H-tetrazole-5-thiol also known as 1-phenyl-5-mercapto-tetrazole has been used, and such by incorporating it in the alkaline aqueous processing liquid and/or in the image-receiving material. Yet, when using said very effective black toning agent in the circumstances wherein alkanolamines including tertiary alkanolamines having favourably low $CO_2$-absorption capacity, are the preponderant alkalinity source, the neutrality of the image tone and reduction of stain in the non-image parts is still to be improved, especially in the lighter shades of the silver image (i.e. in the lower density parts which correspond with the toe of the sensitometric curve) that still show a yellowish colour tone. This is true not only in the case of light-sensitive materials of the negative type producing direct-positive images in the image-receiving material but also and even more pronounced in the case of light-sensitive materials of the direct-positive type producing negative images in the image-receiving material.

SUMMARY OF THE INVENTION

It is an object of the present invention to provide a processing liquid suitable for use in the silver complex diffusion transfer reversal process, which liquid has very low $CO_2$-absorption resulting in more reproducible processing results over several day running of the processing liquid, which has a fairly strong reducing power despite the absence of substantial amounts of strongly pH increasing inorganic bases, and which offers excellent image tone neutrality and practical absence of stain in the non-image parts of the image-receiving element.

It is another object of the present invention to provide a processing liquid suitable for use in the silver complex diffusion transfer reversal process at any suitable temperature which besides being of reproducible use over several day running, is of universal use both for negative as well as direct positive light-sensitive material and both for image-receiving material with opaque paper support as well as image-receiving material with transparent film support.

Another object of the present invention is to provide a method for carrying out the silver complex diffusion transfer reversal (DTR-) process wherein processing results are reproducible over several day running of said processing liquid especially with regard to development speed and image tone neutrality of the processed image-receiving element.

It is a further object of the present invention to provide a said processing wherein some of the processing ingredients are provided by the photographic silver halide emulsion material and/or the image receiving element so as to keep their concentration in the processing liquid within certain ranges and to protect it thereby against exhaustion, by automatic replenishment through the materials to be processed themselves.

Other objects and advantages of this invention will become apparent from the description that follows.

According to the present invention a processing liquid suitable for use in the silver complex diffusion transfer reversal (DTR-) process is provided, wherein said liquid contains one or more alkanolamines, the said alkanolamine(s) consisting of one or more tertiary alkanolamines in a total amount in the range from 0.3 mol/l to 1.5 mol/l, and one or more secondary alkanolamines in an amount from 0 mol % to 5 mol % with respect to the amount of tertiary alkanolamine(s), and said liquid also contains a mixture of a silver image toning agent A being 1-phenyl-1H-tetrazole-5-thiol or a tautomer thereof and at least one other silver image toning agent B being a said 1-phenyl-1H-tetrazole-5-thiol or a tautomer thereof, wherein the phenyl nucleus is substituted with halogen, the toning agent A and toning agent(s) B being present in said liquid in a molar ratio from 1/15 to 15/1. The total concentration of the combination of said toning agents A and B in said liquid is preferably between 30 mg and 300 mg/l, more preferably between 60 mg and 150 mg/l.

According to the present invention a silver complex diffusion transfer reversal (DTR-) process is provided in which an information-wise exposed photographic silver halide emulsion layer is moistened with an aqueous alkaline processing liquid as defined above.

The moistening of said silver halide emulsion layer with said processing liquid proceeds while or before said layer is in relationship with an image-receiving layer to allow therein the transfer of complexed silver ions.

DETAILED DESCRIPTION OF THE INVENTION

According to a first embodiment said processing liquid contains (a) developing agent(s) for silver halide development and substantially none of such agents are present in the exposed photographic silver halide emulsion layer material and/or in the image-receiving element prior to said development.

According to a second embodiment at least part of the developing agent(s) is present in the photographic silver halide emulsion layer material before the material is photo-exposed and reaches the developable silver halide by diffusion with the aid of said processing liquid.

When incorporated in the photographic material, the developing agent(s) can be present in the silver halide emulsion layer or are preferably present in a hydrophilic colloid layer in water-permeable relationship therewith, e.g. in the antihalation layer adjacent to the silver halide emulsion layer of the photosensitive element.

A processing liquid that is initially free from developing agent(s) is called hereinafter "activator liquid".

According to an embodiment said aqueous alkaline processing liquid contains an amount of inorganic alkaline substance(s) other than an alkali metal sulphite in an amount of at most 0.2 mol, preferably less than 0.05 mol per liter e.g. not more than 2 g/liter of sodium hydroxide.

According to a preferred embodiment not only the processing liquid but also the image-receiving element contains at least one of said image toning agents. In said case the image toning agent(s) may gradually transfer by diffusion from said image-receiving element into the processing liquid and keep therein the concentration of said agents almost steady. In practice such can be realized by using the above defined silver image toning agents in a coverage in the range from 1 mg/m$^2$ to 20 mg/m$^2$ in a hydrophilic waterpermeable colloid layer of the image-receiving material.

According to a practical embodiment in the image-receiving element the development nuclei containing layer and/or hydrophilic colloid layer in waterpermeable relationship, or a back layer at the side of the support opposite to that carrying the image receiving layer contains at least part of the silver image toning agents used in the present process. Such procedure results actually in automatic replenishment of toning agent in the processing liquid. The same applies at least partly for the replenishment of the developing agent(s) and silver halide complexing agent(s).

According to another embodiment at least a part of said silver image toning agents is present in the silver halide emulsion material to be developed. Such means that in a practical embodiment at least one of the image toning agents is used in a hydrophilic waterpermeable colloid layer, e.g. antihalation layer at the side of the support opposite to the side coated with a silver halide emulsion layer or between the silver halide emulsion layer and the support. The coverage of said silver image toning agents in said antihalation layer is preferably in the range of 1 mg/m$^2$ to 20 mg/m$^2$.

The preparation of the above defined silver image toning agents is known to those skilled in the art. For example, a preparation method can be applied as described in Canadian Journal of Chemistry, Vol. 35, p. 832 (1957), Vol. 37, p. 101 (1959) or in Journal für praktische Chemie, Band 133, p. 60 (1932).

The use in black-and-white DTR-silver halide photography of 1-phenyl-1H-tetrazole-5-thiol also called 1-phenyl-5-mercapto-tetrazole is described e.g. in GB-P 695,905. The use of 1-(3,4-dichloro-phenyl)-1H-tetrazole-5-thiol and of 1-(2,4-dichloro-phenyl)-1H-tetrazole-5-thiol in dye diffusion transfer processing is described in DE-OS 2 529 488.

The silver image toning agents B provide in addition to a pronounced black silver image in combination with 1-phenyl-5-mercaptotetrazole also a favourable anti-sludge activity, which means that they are counteracting effectively the formation of very fine grain size silver metal deposits in the processing liquid which give rise to a yellow stain in the white background areas of the DTR-print.

Preferred tertiary aminoalkanols for use according to the present invention correspond to the following general formula I:

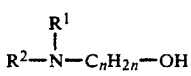

$$R^2-\overset{\overset{\displaystyle R^1}{|}}{N}-C_nH_{2n}-OH \qquad \text{I}$$

wherein:

each of $R^1$ and $R^2$ (same or different) represents a C1–C4 alkyl group or a hydroxy substituted C2–C4 alkyl group, or $R^1$ and $R^2$ together with the nitrogen atom whereto they are linked represent the necessary atoms to form a five or six membered saturated heterocyclic ring, and n represents 1, 2, 3 or 4.

Especially valuable representatives within the scope of the above general formula are listed in the following Table 1 with their pKa value. The notifications between brackets are used in the Example.

TABLE 1

| Compound No. | Structural formula | | pKa value |
|---|---|---|---|
| 1 | $CH_3-N(CH_3)-CH_2-CH_2-OH$ | (DMEA) | 9.31 |
| 2 | $CH_3-CH_2-N(CH_2-CH_3)-CH_2-CH_2-OH$ | (DEEA) | 9.59 |
| 3 | $CH_3-N(CH_2-CH_2-OH)-CH_2-CH_2-OH$ | (MDEA) | 8.52 |
| 4 | $CH_3-CH_2-N(CH_2-CH_2-OH)-CH_2-CH_2-OH$ | (EDEA) | 8.78 |

A single tertiary alkanolamine or a mixture of tertiary alkanolamines having different pKa values may be used in the processing liquid according to the present invention. They generally have a pKa value above 8.5. Preference is given however to the use of at least one tertiary alkanolamine havig a pKa value above 9.

The tertiary alkanolamine(s) may be used in combination with a minor amount of at least one secondary amine [i.e. up to 5 mol % with respect to the amount of the tertiary alkanolamine(s)]. Preferred secondary alkanolamines have a pKa value above 8.5. The secondary alkanolamine may be provided from the image-receiving element by being present either in a back layer or in the image-receiving layer or another layer in water permeable relationship therewith.

Preferred secondary aminoalkanols for use according to the present invention correspond to the following general formula II:

$$H-N(R^1)-C_nH_{2n}-OH \qquad \text{II}$$

wherein:

$R^1$ represents a C1–C4 alkyl group or a hydroxy substituted C2–C4 alkyl group, and n represents 1, 2, 3 or 4.

Especially valuable representatives within the scope of the above general formula II are listed in the following Table 2 with their pKa value. The notifications between brackets are used in the Example.

TABLE 2

| Compound No. | Structural formula | | pKa value |
|---|---|---|---|
| 1 | $CH_3-NH-CH_2-CH_2-OH$ | (MMEA) | 9.57 |
| 2 | $CH_3-CH_2-NH-CH_2-CH_2-OH$ | (MEEA) | 9.67 |
| 3 | $HO-CH_2-CH_2-NH-CH_2-CH_2-OH$ | (DEA) | 8.88 |
| 4 | $CH_3-CH(OH)-CH_2-NH-CH_2-CH(OH)-CH_3$ | (DIPA) | 8.88 |

For the determination by titration of the pKa values the alkanolamine involved is dissolved in water as the sole solvent.

The determination of the pKa values proceeded according to the description given by D. D. Perrin—Dissociation Constants of Organic Bases in Aqueous Solution—London Butterworths (1965).

The tertiary alkanolamine(s) may be used in combination with a minor amount, i.e. not more than 0.2 mol, preferably less than 0.05 mol of an inorganic base per liter, e.g. not more than 2 g/l of sodium hydroxide to bring the pH of the processing liquid in the range of 10.5 to 13 without a substantial increase in $CO_2$-absorption. For ecological reasons the present processing liquid is preferably completely free from phosphate ions.

The optimum pH of the processing liquid according to the present invention depends on the type of silver halide emulsion material to be developed, intended development time and processing temperature.

The processing conditions such as temperature and time may vary within broad ranges on the conditions that mechanical strength of the materials to be processed is not disadvantageously influenced and no decomposition takes place.

The silver halide developing agent used in the process and processing liquid according to the present invention is preferably a p-dihydroxybenzene compound, e.g. hydroquinone, methylhydroquinone or chlorohydroquinone, preferably in combination with an auxiliary developing agent being a 1-phenyl-3-pyrazolidinone-type developing agent and/or p-monomethylaminophenol. When fairly low gradation images for continuous tone reproduction have to be produced preference is given to developing agent combinations as described in U.S. Pat. No. 3,985,561 and 4,242,436.

Preferably hydroquinone-type developing agents are present in the processing liquid according to the present invention in an amount of 0.05 to 0.25 mol per liter. 1-Phenyl-3-pyrazolidinone type developing agents may be present in an amount of $1.8\times10^{-3}$ to $2.0\times10^{-2}$ mol per liter. Particularly useful 1-phenyl-3-pyrazolidinone developing agents are 1-phenyl-3-pyrazolidinone, 1-phenyl-4-monomethyl-3-pyrazolidinone, and 1-phenyl-4,4-dimethyl-3-pyrazolidinone. The latter type of developing agents is advantageously present in the image receiving element.

A suitable quantitative combination of hydroquinone and at least one secondary or auxiliary developing agent of the class of 1-phenyl-3-pyrazolidinones and p-N-methyl-aminophenol comprises hydroquinone in an amount not lower than 0.078 mol per liter of aqueous alkaline solution and the secondary developing agent(s) in an amount not lower than 0.0080 mole per liter, the molar ratio of hydroquinone to said secondary developing agent(s) not being lower than 9.7. Preferred amounts of hydroquinone are in the range of 0.15 mole to 0.20 mole per liter and preferred amounts of secondary developing agent(s) in the range of 0.015 to 0.020 mole per liter.

The silver halide solvent being indispensable in the DTR-process may be supplied from the non-light-sensitive image-receiving element, but it is normally at least partly present already in the alkaline processing solution.

Preferred silver halide solvents are watersoluble thiosulphate compounds such as ammonium and sodium thiosulphate. Other useful silver halide solvents are ammonium and alkali metal thiocyanates.

Other useful silver halide solvents are described in the book "The Theory of the Photographic Process" edited by T. H. James, 4th edition, p. 474–475 (1977), in particular sulphites and uracil. Further interesting silver halide solvents are described in U.S. Pat. Nos. 2,857,276 and 4,297,430, in particular cyclic imides such as 5,5-dialkylhydantoins. Still further are mentioned alkyl sulphones and amines and alkanolamines which also act as silver halide solvents.

When present in the alkaline processing solution, the molar amount of thiosulphate compound is preferably in the range of 0.03 to 0.13 mol/l.

Mixtures of silver halide solvents may be used in order to control the speed of silver complexing and following speed of transfer of the silver complexes, especially in the case of so-called mono-sheet elements as referred to hereinafter.

The alkaline processing solution preferably also contains a preserving agent having antioxidation activity, e.g. sulphite ions provided e.g. by sodium or potassium sulphite. For example, the aqueous alkaline solution comprises sulphite ions in the range from 16 g to 76 g/l e.g. sodium sulphite in an amount ranging from 30 g to 120 g per liter. Further may be present a thickening agent, e.g. hydroxyethylcellulose and carboxymethylcellulose, fog inhibiting agents, e.g. potassium bromide, potassium iodide and a benzotriazole, calcium-sequestering compounds, anti-sludge agents, and hardeners including latent hardeners.

The pH of the aqueous alkaline solution is preferably at least 10.5.

The DTR-image can be formed in the image-receiving layer of a sheet or web material which is a separate element with respect to the photographic silver halide emulsion material or in the image-receiving layer of a so-called single-support-element, also called mono-sheet element, which contains at least one photographic silver halide emulsion layer and the image-receiving layer in waterpermeable relationship therewith, e.g. on top of each other or separated by a thin water-permeable stripping layer or alkali-degradable interlayer as described e.g. in U.S. Pat. No. 3,684,508 or wherein the photographic silver halide emulsion layer is optically masked from the image-receiving layer, e.g. with a whit waterpermeable pigment layer as described e.g. in U.S. Pat. Nos. 3,607,270 and 3,740,220.

The support of the image receiving material may be opaque or transparent, e.g. a paper support or resin support.

The image receiving layer comprises for best imaging results physical development nuclei normally in the presence of a protective hydrophilic colloid, e.g. gelatin and/or colloidal silica.

Preferred development nuclei are sulphides of heavy metals e.g. sulphides of antimony, bismuth, cadmium, cobalt, lead, nickel, palladium, platinum, silver, and zinc. Especially suitable development nuclei are NiS-.$Ag_2S$ nuclei as described in U.S. Pat. No. 4,563,410. Other suitable development nuclei are salts such as e.g. selenides, polyselenides, polysulphides, mercaptans, and tin (II) halides. Heavy metals or salts thereof and fogged silver halide are suitable as well. The complex salts of lead and zinc sulphides are active both alone and when mixed with thioacetamide, dithiobiuret, and dithiooxamide. Heavy metals, preferably silver, gold, platinum, palladium, and mercury can be used in colloidal form.

The image-receiving element may contain in operative contact with the development nuclei thioether compounds, e.g. these described in DE-P 1,124,354, in U.S. Pat. Nos. 4,013,471 and 4,072,526, and in published European Patent Application (EP-A) 0 026 520. Other compounds improving the neutrality of the image tone are e.g. the compounds described in the above mentioned book of André Rott and Edith Weyde, p. 61–65 and in published European Patent Applications Nos. 0 218 752, 0 218 753 and 0 208 346.

Most of the DTR-positive materials now available on the market are composed of two or even three layers. Such materials normally contain on top of the nuclei containing layer a layer which itself contains no nuclei and otherwise has the same composition as the nuclei containing layer and mainly serves to ensure good contact between the negative and positive material during transfer. Moreover, after drying this layer provides a protective coating for the image receiving layer containing the silver image. It further prevents bronzing or plumming of the black image areas in preventing the protruding of silver from the image receiving layer in the form of a glossy silver mirror (ref. the above mentioned book p. 50).

The transfer behaviour of the complexed silver largely depends on the thickness of the image-receiving layer and the kind of binding agent or mixture of binding agents used in the nuclei containing layer. In order to obtain a sharp image with high spectral density the reduction of the silver salts diffusing into the image receiving layer must take place rapidly before lateral diffusion becomes substantial.

An image-receiving material satisfying said purpose is described in published European Patent Application 87201700.9 and is particularly suitable for being processed with an aqueous alkaline processing liquid according to the present invention.

An image-receiving material of this type very suitable for use with a processing liquid according to the present invention contains a water-impermeable support coated with (1) an image-receiving layer containing physical development nuclei dispersed in a waterpermeable binder and (2) a waterpermeable top layer free from development nuclei and containing a hydrophilic colloid, in such a way that:

(i) the total solids coverage of said two layers (1) and (2) is at most 2 $g/m^2$, (ii) in layer (1) the coverage of the nuclei is in the range of 0.1 $mg/m^2$ to 10 $mg/m^2$, and the coverage of binder is in the range of 0.4 to 1.5 $g/m^2$, and (iii) in said top layer (2) the coverage of hydrophilic colloid is in the range of 0.1 to 0.9 $g/m^2$.

The coating of said layers proceeds preferably with slide hopper coater or curtain coater known to those skilled in the art.

A white appearance of the image background even when a yellow stain should appear on storage is obtained by incorporation of optical brightening agents in the support, image-receiving layer and/or interlayer between the support and the image-receiving layer.

According to a particular embodiment the said nuclei containing layer (1) is present on a nuclei-free underlying hydrophilic colloid undercoat layer or undercoat layer system having a coverage in the range of 0.1 to 1 $g/m^2$ of hydrophilic colloid, the total solids coverage of layers (1) and (2) together with the undercoat being at most 2 $g/m^2$.

The undercoat optionally incorporates substances that improve the image quality, e.g. incorporates a substance improving the image-tone or the whiteness of the image background. For example, the undercoat may contain a fluorescent substance, silver complexing agent(s) and/or development inhibitor releasing compounds known for improving image sharpness.

According to a special embodiment the image-receiving layer (1) is applied on an undercoat playing the role of a timing layer in association with an acidic layer serving for the neutralization of alkali of the image-receiving layer. By the timing layer the time before neutralization occurs is established, at least in part, by the time it takes for the alkaline processing composition to penetrate through the timing layer. Materials suitable for neutralizing layers and timing layers are disclosed in Research Disclosure July 1974, item 12331 and July 1975, item 13525.

In the image-receiving layer (1) and/or in said top layer (2) and/or in an undercoat gelatin is used preferably as hydrophilic colloid. In layer (1) gelatin is present preferably for at least 60% by weight and is optionally used in conjunction with another hydrophilic colloid, e.g. polyvinyl alcohol, cellulose derivatives, preferably carboxymethyl cellulose, dextran, gallactomannans, alginic acid derivatives, e.g. alginic acid sodium salt and/or watersoluble polyacrylamides. Said other hydrophilic colloid may be used also in the top layer for at most 10% by weight and in the undercoat in an amount lower than the gelatin content.

The image-receiving layer and/or a hydrophilic colloid layer in water-permeable relationship therewith may comprise a silver halide developing agent and/or silver halide solvent, e.g. sodium thiosulphate in an amount of approximately 0.1 g to approximately 4 g per $m^2$.

The image-receiving layer or a hydrophilic colloid layer in water-permeable relationship therewith may comprise colloidal silica.

The image-receiving layer and/or other hydrophilic colloid layer of the image-receiving material may have been hardened to achieve enhanced mechanical strength. Appropriate hardening agents for hardening the natural and/or synthetic hydrophilic colloid binding agents in the image-receiving layer include e.g. formaldehyde, glyoxal, mucochloric acid, and chrome alum. Hardening can also be effected by incorporating a hardener precursor in the image-receiving layer, the hardening of the hydrophilic colloid therein being triggered by the treatment with the alkaline processing liquid. Other suitable hardening agents for hardening the hydrophilic colloid binding agents in the image-receiving layer are vinylsulphonyl hardeners, e.g. as described in Research Disclosure 22,507 of January 1983.

The image-receiving material can be used in conjunction with any type of photographic silver halide emulsion material suited for use in diffusion transfer reversal processing.

In the photographic material the hydrophilic colloid silver halide emulsion layer can be coated from any photosensitive silver halide emulsion comprising a hydrophilic colloid binder, which usually is gelatin. But instead of or together with gelatin, use can be made of one or more other natural and/or synthetic hydrophilic colloids, e.g. albumin, casein, zein, polyvinyl alcohol, alginic acids or salts thereof, cellulose derivatives such as carboxymethyl cellulose, modified gelatin, e.g. phthaloyl gelatin etc. The weight ratio of hydrophilic colloid binder to silver halide expressed as equivalent amount of silver nitrate to binder is e.g. in the range of 1:1 to 10:1.

The photosensitive silver halide used in the present invention may comprise silver chloride, silver bromide, silver bromoiodide, silver chlorobromoiodide and the like, or mixtures thereof. To obtain a sufficiently high rate of solution of the silver halide and a satisfactory gradation necessary for graphic purposes a silver halide emulsion mainly comprising silver chloride is used preferably. This silver chloride emulsion may comprise minor amounts of silver bromide and/or silver iodide.

The silver halide particles of the photographic emulsions may have a regular crystalline form such as cubic or octahedral form or they may have a transition form. Regular grain emulsions are described e.g. in J. Photogr. Sci., Vol. 12, No. 5, September/October 1964, p. 242–251. The silver halide grains may also have an almost spherical form or they may have a tabular form (so-called T-grains), or may have composite crystal forms comprising a mixture of regular and irregular crystalline forms. The silver halide grains may have a multilayered structure having a core and shell of different halide composition. Besides having a differently composed core and shell the silver halide grains may comprise also different halide compositions and metal dopants inbetween.

Two or more types of silver halide emulsions that have been prepared differently can be mixed for forming a photographic emulsion for use in a photographic material treated with a processing liquid according to the present invention.

The silver halide emulsions may be coarse or fine grain and can be prepared by any of the well known procedures e.g. single jet emulsions, double jet emulsions such as Lippmann emulsions, ammoniacal emulsions, thiocyanate- or thioether-ripened emulsions such as those described in U.S. Pat. Nos. 2,222,264, 3,320,069, and 3,271,157. Surface image emulsions may be used or internal image emulsions may be used such as those described in U.S. Pat. Nos. 2,592,250, 3,206,313, and 3,447,927. If desired, mixtures of surface and internal image emulsions may be used as described in U.S. Pat. No. 2,996,382.

Apart from negative-working silver halide emulsions that are preferred for their high light-sensitivity, use can be made also of direct-positive silver halide emulsions that produce a positive silver image.

For instance, direct-positive emulsions of the type described in U.S. Pat. No. 3,062,651 may be employed. In direct-positive emulsions a non-hardening fogging agent such as stannous chloride and formamidine sulphinic acid can be used.

The emulsions can be chemically sensitized e.g. by adding sulphur-containing compounds during the chemical ripening stage e.g. allyl isothiocyanate, allyl thiourea, and sodium thiosulphate. Also reducing agents e.g. the tin compounds described in BE-A 493,464 and 568,687, and polyamines such as diethylene triamine or derivatives of aminomethane-sulphonic acid can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z. Wiss. Photogr. Photophys. Photochem. 46, 65–72 (1951).

The emulsions can also be sensitized with polyalkylene oxide derivatives, e.g. with polyethylene oxide having a molecular weight of 1000 to 20,000, or with condensation products of alkylene oxides and aliphatic alcohols, glycols, cyclic dehydration products of hexitols, alkyl-substituted phenols, aliphatic carboxylic acids, aliphatic amines, aliphatic diamines and amides. The condensation products have a molecular weight of at least 700, preferably of more than 1000. It is also possible to combine these sensitizers with each other as described in BE-A 537,278 and GB-A 727,982.

The spectral photosensitivity of the silver halide can be adjusted by proper spectral sensitization by means of the usual mono- or polymethine dyes such as acidic or basic cyanines, hemicyanines, oxonols, hemioxonols, styryl dyes or others, also tri- or polynuclear methine dyes e.g. rhodacyanines or neocyanines. Such spectral sensitizers have been described by e.g. F. M. HAMER in "The Cyanine Dyes and Related Compounds" (1964) Interscience Publishers, John Wiley & Sons, New York.

The silver halide emulsions may contain the usual stabilizers e.g. homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxy or amino groups. Compounds of this kind have been described by BIRR in Z. Wiss. Photogr. Photophys. Photochem. 47, 2–27 (1952). Other suitable stabilizers are i.a. heterocyclic mercapto compounds e.g. phenylmercaptotetrazole, quaternary benzothiazole derivatives, and benzotriazole.

Either or not in combination with one or more developing agents into the silver halide emulsions may contain pH controlling ingredients, and other ingredients such as antifogging agents, development accelerators, wetting agents, and hardening agents for gelatin.

The silver halide emulsion layer may comprise light-screening dyes that absorb scattering light and thus promote the image sharpness and, as a consequence thereof, the sharpness of the final printed copy. Light-absorbing dyes that can be used as light-screening dyes have been described in i.a. U.S. Pat. No. 4,092,168, U.S. Pat. No. 4,311,787, DE-A 2,453,217, and GB-A 7,907,440. More details about the composition, preparation and coating of silver halide emulsions can be found in e.g. Product Licensing Index, Vol. 92, December 1971, publication 9232, p. 107–109.

As an interesting variant the silver halide emulsion may consist of a first light-sensitive silver halide emulsion in which a normal latent image is formed upon image-wise exposure and a second silver halide emulsion whose speed is so low that no or almost no latent image is formed therein. When the low-speed silver halide emulsion and the light-sensitive silver halide emulsion are coated to form different layers, the resulting emulsion layers are arranged in DTR-processing in such a way that the low-speed emulsion is remotest from the image-receiving layer. It is also possible to coat one single layer comprising a mixture of both types of emulsion.

Thanks to the combination of light-sensitive and low-speed emulsions a silver image having an enhanced contrast can be obtained. Such may be explained by the fact that upon application of an aqueous alkaline solution to the image-wise exposed light-sensitive silver halide emulsion layer system in the presence of a developing agent and a silver halide solvent a silver image is formed in the image-receiving layer from the additionally obtained silver complexes in the low-speed emulsion layer. No image-background staining in the DTR-print takes place because the reduced silver of the light-sensitive emulsion forms a barrier for silver halide or complexes of the low-speed emulsion that would also tend to migrate towards the image-receiving element. As a result, the silver halide or complexes thereof diffusing from both the light-sensitive emulsion and the low-speed emulsion together build up said strengthened high-contrast silver image in the image receiving layer.

As the sensitivity of the low speed emulsion must be low enough to be inert in the photo-exposure, no second ripening or after-ripening thereof is applied.

The low-speed emulsion may be a pure silver chloride emulsion or an emulsion of mixed silver halides comprising silver chloride e.g. a silver chlorobromide or chlorobromoiodide emulsion. However, the low-speed emulsion is preferably a silver chloride emulsion for the greater part. Preferably a fine-grain silver chloride having a particle size in the range of 50 to 500 nm is used.

In case a mixture of low-speed emulsion and of imaging emulsion is coated to form one single layer, the amount of low-speed emulsion may vary within wide limits. Favourable results can be obtained when the ratio of low-speed silver chloride-containing emulsion to image-forming emulsion, expressed in parts by weight of silver nitrate, ranges from 10:1 to 1:1. The amount of low-speed emulsion to be added depends i.a. on its own nature, on the type of image-forming emulsion used, and on the effect desired. It can be determined easily by routineers in the art by making a few comparative tests.

The silver halide emulsion coated side of the photographic material can be provided with a top layer that contains hydrophilic colloids that form a waterpermeable layer. Such top layer is usually free of gelatin. Its nature is such that it does not inhibit or restrain the diffusion transfer of the complexed silver but acts e.g. as an anti-stress layer. Appropriate hydrophilic binding agents for such top layer are e.g. methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, poly-N-vinyl pyrrolidinone, polyoxyethylene, and copoly(methylvinylether/maleic acid). The thickness of this layer depends on the nature of the colloid used and the required mechanical strength. Such layer if present may be transferred at least partially to the image-receiving layer without deleterious action on the image formation.

The development and diffusion transfer can be initiated in different ways e.g. by rubbing with a roller that has been wetted with the processing liquid, e.g. acts as meniscus coater, by wiping with an absorbent means e.g. with a plug of cotton or sponge, or by dipping the material to be treated in the liquid composition. Preferably, they proceed in an automatically operated apparatus such as the COPYPROOF (registered trade name of AGFA-GEVAERT N.V. Belgium) type CP 38, CP 380, CP 42 or CP 530 processors. The DTR-process is normally carried out at a temperature in the range of 10° C. to 35° C.

The following example illustrates the present invention without however, limiting it thereby. All parts, percentages and ratios are by weight unless otherwise indicated.

EXAMPLE

Preparation of Negative Working Silver Halide Emulsion Material (N)

A paper support having a weigth of 110/m$^2$ and coated at both sides with a polyethylene layer was coated at one side with an antihalation layer on the basis of carbon black dispersed in gelatin wherein also hydroquinone and 1-phenyl-4-methylpyrazolidin-3-on were present in a coverage of 0.57 g/m$^2$ and 0.32 g/m$^2$. On said antihalation layer an orthochromatically sensitized negative working gelatino silver halide emulsion layer containing an amount of silver chlorobromide (1.8 mol % bromide) equivalent to 2.0 g/m$^2$ of silver nitrate was coated. The average grain size of the silver chlorobromide was 0.3 microns. The silver halide emulsion layer was overcoated with a thin protective gelatin layer.

Preparation of Direct-Positive Working Silver Halide Emulsion Material (M)

The direct-positive working silver halide emulsion material (M) was prepared analogously to Material C of the Example of U.S. Pat. No. 4,144,064.

Preparation of Image-Receiving Material (A)

One side of a paper support having a weight of 110 g/m$^2$ and coated at both sides with a polyethylene layer was coated at a dry coverage of 2 g/m$^2$ with an image-receiving layer containing silver-nickel sulphide nuclei and gelatin. This layer was applied by slide hopper coating so that the nuclei were in an undermost coating of 1.3 g gelatin per sq.m. and a top layer was provided of 0.7 g gelatin per sq.m.

Preparation of Image-Receiving Material (B1)

A subbed polyethylene terephthalate film support was coated at both sides at a dry coverage of 2.8 g/m$^2$ with an image-receiving layer containing silver sulphide nuclei dispersed in gelatin, and the gelatin layer also containing an amount of sodium thiosulphate corresponding with a coverage of 0.68 g/m$^2$. The gelatin was hardened with formaldehyde.

Preparation of Image-Receiving Material (B2)

A subbed polyethylene terephthalate film support was coated at both sides at a dry coverage of 1.8 g/m$^2$ with an image-receiving layer containing silver-nickel sulphide nuclei dispersed in gelatin. This layer was applied by slide hopper coating so that the nuclei were in an undermost coating of 1.4 g gelatin per sq.m. and a top layer was provided of 0.4 g gelatin per sq.m.

Exposure Procedure

The photographic materials were exposed through a sensitometric wedge in a contact exposure apparatus operating with a light source having a colour temperature of 3200° K.

DTR-Transfer Procedure

The exposed photographic materials were pre-moistened with the hereinafter defined processing liquids, the contact time with said liquid being 6 seconds before being pressed together with an image-receiving material as defined above. The transfer processor employed was a COPYPROOF (registered trade name of AGFA-GEVAERT N.V.) type CP 380. The transfer contact time was 30 seconds for the paper type image receiving materials and 60 seconds for the resin film type image receiving materials. Several transfers were carried out at different processing liquid temperatures being 15, 22 and 32° C. respectively.

The influence of the actual $CO_2$-absorption on the image quality was evaluated by processing sets of photographic materials (N) and (M) with image-receiving materials A, B1 and B2, respectively with processing liquids that had been exposed before use for 24 and 96 hours respectively to an atmosphere of 85% relative humidity containing 2500 ppm of $CO_2$. The $CO_2$ atmosphere was obtained in a closed box with a $CO_2$-flow of 2.5 l/min under atmospheric pressure.

The obtained test wedge prints in the image-receiving materials were evaluated with regard to maximum density ($D_{max}$), image colour tone and gradation (gamma-value), the results of which are listed in the following tables.

Evaluation

All wedge prints were measured on a densitometer MACBETH (registered trade name) type IR 924 behind visual filter having following wavelength (nm)/optical density (D) characteristics: 700 nm/D=0; 600 nm/D=0.2; 500 nm/D=1.25; 420 nm/D=3.0.

For the DTR-prints obtained on paper base image-receiving materials maximum reflection density was measured ($D_{max}$R), and the gamma value (maximum gradient of the straigth line portion of the sensitometric curve). The reflection density measurement proceeded according to American National Standard for Photography (Sensitometry) ANSI PH2.17-1985.

For the DTR-prints obtained on transparent resin film base image-receiving materials maximum transmission density was measured ($D_{max}$ T), and the gamma value (maximum gradient of the straigth line portion of the sensitometric curve). The transmission density measurement proceeded according to American National Standard for Photography (Sensitometry) ANSI PH2.19-1986.

| | Composition of processing solutions | | | | | | | | | | | |
|---|---|---|---|---|---|---|---|---|---|---|---|---|
| Ingredient | A | B | C | D | E | F | G | H | I | J | K | L |
| I (g) | 1.5 | 1.5 | 1.5 | 1.5 | 1.5 | 1.5 | 1.5 | 1.5 | 1.5 | 1.5 | 1.5 | 1.5 |
| II (g) | 2.0 | 2.0 | 2.0 | 2.0 | 2.0 | 2.0 | 2.0 | 2.0 | 2.0 | 2.0 | 2.0 | 2.0 |

-continued

| Ingredient | Composition of processing solutions | | | | | | | | | | | |
|---|---|---|---|---|---|---|---|---|---|---|---|---|
| | A | B | C | D | E | F | G | H | I | J | K | L |
| III (g) | 45.0 | 45.0 | 45.0 | 45.0 | 45.0 | 45.0 | 45.0 | 45.0 | 45.0 | 45.0 | 45.0 | 45.0 |
| IV (g) | 12.0 | 12.0 | 12.0 | 12.0 | 12.0 | 12.0 | 12.0 | 12.0 | 12.0 | 12.0 | 12.0 | 12.0 |
| V (g) | 0.5 | 0.5 | 0.5 | 0.5 | 0.5 | 0.5 | 0.5 | 0.5 | 0.5 | 0.5 | 0.5 | 0.5 |
| VI (g) | 13.0 | 13.0 | 13.0 | 13.0 | 13.0 | 13.0 | 13.0 | 13.0 | 13.0 | 13.0 | 13.0 | 13.0 |
| VII (g) | 4.7 | 4.7 | 4.7 | 4.7 | 4.7 | 4.7 | 4.7 | 4.7 | 4.7 | 4.7 | 4.7 | 4.7 |
| VIII | .120 | .080 | 0 | .120 | .080 | 0 | .120 | .080 | 0 | .120 | .080 | 0 |
| IX | 0 | .040 | .120 | 0 | .040 | .120 | 0 | .040 | .120 | 0 | .040 | .120 |
| MMEA (mole) | .25 | .25 | .25 | 0 | 0 | 0 | 0 | 0 | 0 | 0 | 0 | 0 |
| DEEA (mole) | 0 | 0 | 0 | .70 | .70 | .70 | .35 | .35 | .35 | 0 | 0 | 0 |
| MDEA (mole) | .39 | .39 | .39 | 0 | 0 | 0 | 0 | 0 | 0 | .35 | .35 | .35 |
| DMEA (mole) | 0 | 0 | 0 | 0 | 0 | 0 | .35 | .35 | .35 | .35 | .35 | .35 |
| NAOH (g) | 2 | 2 | 2 | * | * | * | * | * | * | * | * | * |
| Water up to | 1 l | 1 l | 1 l | 1 l | 1 l | 1 l | 1 l | 1 l | 1 l | 1 l | 1 l | 1 l |

I: Hydroxyethylcellulose
II: Ethylenediaminetetraacetic acid tetrasodium salt
III: $NA_2SO_3$ (anhydrous)
IV: $NA_2S_2O_3$ (anhydrous)
V: KBr
VI: Hydroquinone
VII: 1-Phenyl-4-methyl-3-pyrazolidinone
VIII: 1-Phenyl-5-mercapto-tetrazole
IX: 1-(3,4-Dichloro-phenyl)-1H-tetrazole-5-thiol
*NAOH added to pH = 10.80 for D to L

TABLE I

Combination of Photosensitive materials N with image receiving materials A, B1 and B2 respectively. $CO_2$-exposure: 0 hours. Processing temperature: 22° C. for materials A, B1, 15, 22 and 32° C. respectively for materials B2.

| Processing solution | A (22° C.) | | Image* colour tone | B1 (22° C.) | | B2 (22° C.) | | B2 (15° C.) | | B2 (32° C.) | |
|---|---|---|---|---|---|---|---|---|---|---|---|
| | $D_{max}$ R | Gamma | | $D_{max}$ T | Gamma | $D_{max}$ T | Gamma | $D_{max}$ T | Gamma | $D_{max}$ T | Gamma |
| A | 1.93 | 20.1 | B | 3.31 | 17.5 | 3.73 | 13.9 | 3.65 | 13.4 | 3.54 | 14.4 |
| B | 1.98 | 23.9 | N | 3.62 | 19.0 | 3.81 | 15.5 | 3.73 | 14.2 | 3.62 | 15.5 |
| C | 1.80 | 31.8 | N | 4.28 | 20.3 | 4.03 | 21.0 | 4.45 | 19.5 | 3.96 | 18.0 |
| D | 2.00 | 17.3 | B | 3.73 | 14.6 | 3.61 | 13.8 | 3.50 | 13.8 | 3.68 | 15.6 |
| E | 1.98 | 21.3 | N | 3.02 | 15.7 | 3.66 | 15.5 | 3.61 | 14.8 | 3.23 | 14.7 |
| F | 1.88 | 28.5 | N | 3.68 | 18.9 | 4.35 | 20.9 | 4.32 | 20.4 | 4.06 | 15.3 |
| G | 1.98 | 18.2 | B | 2.93 | 15.9 | 3.63 | 14.1 | 3.61 | 14.0 | 3.56 | 15.3 |
| H | 2.00 | 24.8 | N | 3.50 | 18.3 | 3.68 | 15.9 | 3.87 | 15.1 | 3.76 | 16.0 |
| I | 1.90 | 30.7 | N | 4.07 | 21.2 | 4.38 | 20.3 | 4.37 | 20.5 | 4.10 | 18.3 |
| J | 1.94 | 18.6 | B | 3.50 | 17.9 | 3.71 | 13.9 | 3.66 | 14.1 | 3.84 | 14.6 |
| K | 1.94 | 22.4 | N | 3.72 | 19.6 | 3.82 | 16.2 | 3.87 | 15.4 | 3.84 | 16.6 |
| L | 1.74 | 30.8 | N | 4.18 | 24.6 | 4.27 | 20.8 | 4.38 | 19.2 | 4.22 | 18.7 |

*in highlight areas:
B = brown
N = neutral black

TABLE II

Combination of Photosensitive materials N with image receiving materials A at Processing temperatures 15°, 22° and 32° C. respectively and after having subjected the processing liquids to $CO_2$ exposures for 24 hours and 96 hours respectively as indicated.

| Processing solution | 15° C./ 24 hrs $CO_2$ | | 15° C./ 96 hrs $CO_2$ | | 22° C./ 24 hrs $CO_2$ | | 22° C./ 96 hrs $CO_2$ | | 32° C./ 24 hrs $CO_2$ | | 32° C./ 96 hrs $CO_2$ | |
|---|---|---|---|---|---|---|---|---|---|---|---|---|
| | $D_{max}$ R | Gamma | $D_{max}$ R | Gamma | $D_{max}$ R | Gamma | $D_{max}$ R | Gamma | $D_{max}$ R | Gamma | $D_{max}$ R | Gamma |
| A | 1.36 | 5.7 | 0.96 | 3.6 | 1.76 | 8.7 | 1.27 | 5.5 | 1.87 | 15.6 | 1.58 | 8.9 |
| B | 1.47 | 7.8 | 1.14 | 5.2 | 1.73 | 11.0 | 1.40 | 7.8 | 1.84 | 16.4 | 1.66 | 11.5 |
| C | 1.40 | 13.3 | 1.53 | 11.8 | 1.77 | 21.7 | 1.80 | 15.9 | 1.63 | 18.9 | 1.68 | 15.0 |
| D | 1.86 | 9.8 | 1.38 | 7.3 | 2.04 | 14.0 | 1.52 | 8.8 | 2.04 | 25.4 | 1.95 | 21.6 |
| E | 1.97 | 13.6 | 1.48 | 8.7 | 2.00 | 14.7 | 1.60 | 10.2 | 1.85 | 16.7 | 1.77 | 13.2 |
| F | 1.64 | 22.1 | 1.76 | 18.5 | 1.76 | 25.6 | 1.88 | 20.5 | 1.67 | 19.3 | 1.78 | 16.3 |
| G | 1.82 | 10.1 | 1.34 | 7.0 | 2.07 | 15.1 | 1.77 | 11.7 | 2.03 | 28.0 | 1.98 | 25.7 |
| H | 2.03 | 17.0 | 1.99 | 13.7 | 2.06 | 19.0 | 1.86 | 15.7 | 1.73 | 22.5 | 1.84 | 18.7 |
| I | 1.85 | 25.6 | 1.94 | 23.7 | 1.81 | 27.1 | 1.92 | 27.7 | 1.67 | 20.6 | 1.76 | 22.4 |
| J | 1.96 | 11.8 | 1.84 | 10.8 | 2.07 | 16.0 | 1.96 | 14.2 | 1.95 | 27.4 | 1.90 | 24.3 |
| K | 1.96 | 15.8 | 1.87 | 12.3 | 2.04 | 21.6 | 1.96 | 18.1 | 1.85 | 26.9 | 1.84 | 22.9 |
| L | 1.62 | 20.6 | 1.66 | 18.7 | 1.72 | 29.5 | 1.75 | 30.9 | 1.57 | 25.5 | 1.61 | 25.0 |

TABLE III

Combination of Photosensitive materials N with image receiving materials B2. Processing temperature: 32° C. $CO_2$ exposure: 24 hrs/96 hrs respectively.

| Processing solution | 24 hrs $CO_2$ | | 96 hrs $CO_2$ | |
|---|---|---|---|---|
| | $D_{max}$ T | Gamma | $D_{max}$ T | Gamma |
| A | 3.27 | 15.6 | 2.82 | 14.9 |
| B | 3.20 | 18.6 | 2.97 | 18.0 |
| C | 3.56 | 21.9 | 3.10 | 19.3 |
| D | 3.24 | 17.1 | 3.12 | 17.4 |
| E | 3.27 | 18.2 | 3.00 | 19.6 |
| F | 3.55 | 20.1 | 3.21 | 21.1 |
| G | 3.41 | 17.3 | 3.49 | 18.0 |
| H | 3.46 | 18.0 | 3.27 | 19.0 |
| I | 3.57 | 20.2 | 3.38 | 20.3 |
| J | 3.43 | 16.9 | 3.25 | 17.7 |
| K | 3.41 | 17.5 | 3.35 | 19.0 |
| L | 3.82 | 20.3 | 3.74 | 21.9 |

TABLE IV

Combination of Photosensitive materials M with image receiving materials A, B1 and B2 respectively. Processing temperatures 22° C. and $CO_2$ exposure of the processing liquids as indicated.

| Processing solution | A 22° C./ 0 hrs $CO_2$ | | B1 22° C./ 0 hrs $CO_2$ | | B2 22° C./ 0 hrs $CO_2$ | | B2 32° C./ 0 hrs $CO_2$ | | B2 32° C./ 96 hrs $CO_2$ | |
|---|---|---|---|---|---|---|---|---|---|---|
| | $D_{max}$ R | Gamma | $D_{max}$ T | Gamma | $D_{max}$ T | Gamma | $D_{max}$ T | Gamma | $D_{max}$ T | Gamma |
| A | 2.16 | 15.2 | 2.80 | 19.4 | 3.96 | 16.4 | 2.75 | 21.5 | 2.31 | 23.0 |
| B | 2.16 | 20.4 | 3.63 | 22.8 | 4.07 | 14.3 | 3.27 | 19.7 | 2.39 | 20.9 |
| C | 1.95 | 26.8 | 3.96 | 22.3 | 3.98 | 13.3 | 3.78 | 28.8 | 2.98 | 24.8 |
| D | 2.17 | 15.9 | 2.54 | 21.6 | 4.26 | 19.2 | 3.34 | 10.2 | 2.80 | 24.6 |
| E | 1.94 | 13.7 | 2.80 | 20.2 | 4.28 | 18.1 | 2.94 | 5.4 | 3.44 | 20.5 |
| F | 1.92 | 18.9 | 3.36 | 21.9 | 4.34 | 18.3 | 3.96 | 21.0 | 3.28 | 27.1 |
| G | 2.18 | 15.1 | 2.72 | 17.5 | 4.10 | 18.5 | 3.32 | 14.0 | 2.95 | 27.0 |
| H | 2.05 | 15.6 | 3.46 | 21.5 | 3.99 | 14.6 | 3.34 | 17.4 | 3.15 | 38.0 |
| I | 2.04 | 26.0 | 4.26 | 26.3 | 4.32 | 16.0 | 3.63 | 22.8 | 3.30 | 40.5 |
| J | 2.06 | 13.4 | 3.74 | 19.8 | 3.97 | 11.9 | 3.60 | 26.0 | 3.10 | 29.8 |
| K | 2.15 | 15.7 | 4.08 | 20.7 | 4.21 | 17.7 | 3.70 | 32.9 | 3.27 | 30.9 |
| L | 1.97 | 24.5 | 4.50 | 20.9 | 4.51 | 22.6 | 4.38 | 68.1 | 3.69 | 46.2 |

From the data in the above tables there can be concluded that the best results regarding high gradation both on paper and film, high transmission density and high reflection density as well as neutral image tone, are obtained with an alkaline processing liquid, comprising an alkanolamine wherein the alkanolamine part mainly consists of tertiary alkanolamines and black toning agents were used in combination as defined in the main claim.

The above data further show the versatility of use of the latter processing liquid at various temperatures, with both negative and direct positive silver halide materials and with both film and paper receiving materials.

They further show the favourable stability under $CO_2$-containing atmosphere offering a several day running life time without substantially impairing image quality.

We claim:

1. An aqueous alkaline processing liquid suitable for use in the silver complex diffusion transfer reversal (DTR-) process, wherein said liquid contains one or more alkanolamines, the said alkanolamine(s) consisting of one or more tertiary alkanolamines in a total amount in the range from 0.3 mol/l to 1.5 mol/l, and one or more secondary alkanolamines in an amount from 0 mol % to 5 mol % with respect to the amount of tertiary alkanolamine(s), and said liquid also contains a mixture of a silver image toning agent A being 1-phenyl-1H-tetrazole-5-thiol or a tautomer thereof and at least one other silver image toning agent B being a 1-phenyl-1H-tetrazole-5-thiol or a tautomer thereof, wherein the phenyl nucleus is substituted with halogen, the toning agent A and toning agent(s) B being present in said liquid in a molar ratio from 1/15 to 15/1.

2. An aqueous alkaline processing liquid according to claim 1 wherein the concentration of the combination of said toning agents A and B in said liquid is between 30 mg and 300 mg/liter.

3. An aqueous alkaline processing liquid according to claim 1, wherein said toning agent B is 1-(2,4-dichloro-phenyl)-1H-tetrazole-5-thiol or 1-(3,4-dichloro-phenyl)-1H-tetrazole-5-thiol.

4. An aqueous alkaline processing liquid according to claim 1, wherein the pKa value of said alkanolamine(s) is at least 8.5.

5. An aqueous alkaline processing liquid according to claim 1, wherein the pKa value of said tertiary alkanolamine(s) is at least 9.

6. An aqueous alkaline processing liquid according to claim 1, wherein said liquid contains an amount of inorganic alkaline substance(s) other than an alkali metal sulphite in an amount of at most 0.2 mol per liter.

7. An aqueous alkaline processing liquid according to claim 1, wherein said liquid contains dissolved sulphite ions in a concentration in the range of 16 g to 76 g/l.

8. An aqueous alkaline processing liquid according to claim 1, wherein said liquid contains dissolved thiosulphate ions in a concentration in the range of 0.03 to 0.13 mol/l.

9. An aqueous alkaline processing liquid according to claim 1, wherein said tertiary alkanolamines are selected from the group consisting of DMEA, DEEA, MDEA, EDEA, as defined herein.

10. An aqueous alkaline processing liquid according to claim 1, wherein said secondary alkanolamines are selected from the group consisting of MMEA, MEEA, DEA, DIPA, as defined herein.

11. A silver complex diffusion transfer reversal process which is carried out by development of an information-wise exposed silver halide emulsion layer with a developing agent in the presence of a silver halide solvent to form diffusible silver complexes which diffuse into an image-receiving layer containing development nuclei, and in which said information-wise exposed photographic silver halide emulsion layer is moistened with an aqueous alkaline processing liquid, wherein said liquid contains one or more alkanolamines, the said alkanolamine(s) consisting of one or more tertiary alkanolamines in a total amount in the range from 0.3 mol/l to 1.5 mol/l, and one or more secondary alkanolamines in an amount from 0 mol % to 5 mol % with respect to the amount of tertiary alkanolamine(s), and said liquid also contains a mixture of a silver image toning agent A being 1-phenyl-1H-tetrazole-5-thiol or a tautomer thereof and at least one other silver image toning agent B being a 1-phenyl-1H-tetrazole-5-thiol or a tautomer thereof, wherein the phenyl nucleus is substituted with halogen, the toning agent A and toning agent(s) B being present in said liquid in a molar ratio from 1/15 to 15/1.

12. A silver complex diffusion transfer reversal process according to claim 11, wherein the moistening of said silver halide emulsion layer with said processing liquid proceeds while or before said layer is in relationship with an image-receiving layer to allow therein the transfer of complexed silver ions.

13. A silver complex diffusion transfer reversal process according to claim 12, wherein said image-receiving layer and/or a hydrophilic colloid layer in waterpermeable relationship and/or a back layer at the side of the support opposite to that carrying the image receiving layer, contains at least a part of said silver image toning agents.

14. A silver complex diffusion transfer process according to claim 13, wherein the coverage of said silver image toning agents in said layer(s) is in the range from 1 $mg/m^2$ to 20 $mg/m^2$.

15. A silver complex diffusion transfer process according to claim 11, wherein at least a part of said silver image toning agents is present in the silver halide emulsion material in an antihalation layer at the side of the support opposite to the side coated with a silver halide emulsion layer or between the support and the silver halide emulsion layer.

16. A silver complex diffusion transfer process according to claim 15, wherein the coverage of said silver image toning agents in said antihalation layer is in the range from 1 $mg/m^2$ to 20 $mg/m^2$.

17. A silver complex diffusion transfer process according to claim 11, wherein said image receiving material contains a water-impermeable support coated with (1) an image receiving layer containing physical development nuclei dispersed in a waterpermeable binder and (2) a waterpermeable top layer free from development nuclei and containing a hydrophilic colloid, in such a way that (i) the total solids coverage of said two layers (1) and (2) is at most 2 $g/m^2$, (ii) in layer (1) the coverage of the nuclei is in the range of 0.1 $mg/m^2$ to 10 $mg/m^2$, and the coverage of binder is in the range of 0.4 to 1.5 $g/m^2$, and (iii) in said top layer (2) the coverage of hydrophilic colloid is in the range of 0.1 to 0.9 $g/m^2$.

* * * * *